United States Patent [19]

Tims et al.

[11] Patent Number: 4,545,041

[45] Date of Patent: Oct. 1, 1985

[54] SHOCK-HARDENED HYDROPHONE

[75] Inventors: Allan C. Tims; Theodore A. Henriquez, both of Orlando, Fla.

[73] Assignee: The United States of America as represented by the Secretary of the Navy, Washington, D.C.

[21] Appl. No.: 437,083

[22] Filed: Oct. 27, 1982

[51] Int. Cl.[4] ..... H04R 17/00

[52] U.S. Cl. ..... 367/157; 367/152; 367/165; 367/155

[58] Field of Search ..... 367/140, 155, 157, 160, 367/165, 167, 158; 310/348, 354, 369

[56] References Cited

U.S. PATENT DOCUMENTS

| | | | |
|---|---|---|---|
| 2,849,628 | 8/1958 | Hollmann | 367/157 X |
| 3,054,982 | 9/1962 | Kieser | 367/157 |
| 3,243,767 | 3/1966 | Kendig et al. | 367/155 X |
| 3,263,210 | 7/1966 | Schloss | 367/165 X |
| 3,304,534 | 2/1967 | Sykes | 367/152 X |
| 3,320,580 | 5/1967 | Sykes | 367/157 |
| 3,320,581 | 5/1967 | Sims | 367/157 |
| 3,320,582 | 5/1967 | Sykes | 367/157 |
| 3,539,980 | 11/1970 | Massa, Jr. | 367/157 X |
| 3,713,086 | 1/1973 | Trott | 367/155 X |
| 3,716,828 | 2/1973 | Massa | 310/369 X |
| 3,846,744 | 11/1974 | Renna, Jr. et al. | 367/152 |

*Primary Examiner*—Harold J. Tudor
*Assistant Examiner*—Brian S. Steinberger
*Attorney, Agent, or Firm*—Robert F. Beers; William T. Ellis; Charles E. Krueger

[57] ABSTRACT

A shock-hardened hydrophone comprising a sensor electrically connected to a low output-impedance preamplifier by a circuitboard. The sensor includes two metal cups, each cup with a piezoelectric ceramic disk positioned therein for generating a potential difference between the first and second surfaces of the disk. The cups are bolted together with the circuitboard positioned between the disks. The second surfaces of the disk are in pressure contact with the cups while the first surfaces are in pressure contact with a first electrode disposed on both sides of the circuitboard. A wire connects one of the metal cups to a second electrode disposed on either side of the circuitboard thereby completing the electrical connection of the disks to the electrodes on the circuitboard. The preamplifier is mounted on the circuitboard where the input to the preamplifier is the voltage difference between the first and second electrodes.

14 Claims, 2 Drawing Figures

SHOCK-HARDENED HYDROPHONE

BACKGROUND OF THE INVENTION

The invention relates generally to hydrophones and more particularly to shock-hardened hydrophones.

Many underwater applications such as geophysical prospecting and submarine warfare require a hydrophone that is capable of functioning after being exposed to an explosive shock. Shock-hardening is generally achieved in a hydrophone utilizing piezoelectric transducers by mechanically pre-loading the transducers. This pre-loading prevents the transducer from shattering due to forces present in a high shock environment. Existing shock-hardened hydrophones utilize complicated methods, such as winding with a fiber glass layer, to achieve the required pre-load.

Additional desirable hydrophone qualities include ease of fabrication for reducing cost and low output-impedance for driving long cables. Existing hydrophones utilize piezoelectric sensors with foil electrodes mounted thereon, thus requiring that input wires from an amplifier be soldered to small protruding foil tabs on the foil electrodes. This soldering is a time-consuming, expensive operation.

Additionally, transformers are often utilized to provide low output-impedance in existing hydrophones. However, the transformers are neither inexpensive nor reliable.

OBJECTS OF THE INVENTION

It is therefore an object of the invention to provide a low cost, shock-hardened, reliable hydrophone.

It is a further object of the invention to provide a hydrophone which is easily fabricated and thus inexpensive.

SUMMARY OF THE INVENTION

The above and other objects are achieved in the present invention which includes in combination, a piezoelectric sensor electrically connected to a low output-impedance preamplifier by a circuitboard. The sensor comprises a pair of disk shaped piezoelectric transducers, where each acoustic transducer is poled along the longitudinal axis. Thus. an axial mechanical strain on the disk will create a potential difference between the two planar surfaces of the disk. The two planar surfaces of each disk are designated the first and second surfaces where the sign of the potential difference between the first and the second surface of each disk is the same.

Each disk is enclosed in a metal housing and the metal housings are subsequently clamped together with the disks and a circuitboard captured therebetween. The disks are mechanically pre-loaded due to the axial force exerted by the clamping mechanism. Thus, the present invention provides an uncomplicated method for shock hardening the hydrophone. A layer of pressure release material positioned between the sides of the metal housings and the disks increases the sensitivity of the sensors.

In one embodiment, the disks, metal housing and circuitboard are oriented so that the first surfaces of the disks are in pressure contact with a first electrode, which is part of a preamplifier foil pattern disposed on both surfaces of the circuitboard thereby causing the first electrode to be at the same potential as the first surfaces of the disks.

The second surfaces of the disks are in pressure contact with the metal housings. Since the clamping mechanism electrically connects the metal housings, both metal housings are at the same potential as the second surfaces of the disks. The metal housings are designed so that a small gap is formed between the metal housings and the circuitboard to prevent a short circuit between the first and second surfaces of the disks. A wire soldered to a metal housing and a second electrode of the preamplifier circuit pattern causes the second electrode to be at the same potential as the second surfaces of the disks thereby completing the electrical connection between the sensor and the circuitboard. The electronic components of a low output-impedance preamplifier are soldered to the circuitboard in a conventional manner. Thus, the preamplifier and the sensor are electrically connected by the circuitboard.

Note that the present invention eliminates the need for foil electrodes, mounted on the disks, with delicate tabs for soldering connections. The unique clamped together configuration of the sensor of the invention results in the direct electrical connection of the disks to the metal cups and the first electrode on the circuitboard. The steps of soldering connections from the metal cups and preamplifier to the circuitboard are simple and efficient. Additionally, the low output-impedance preamplifier eliminates the requirement of expensive, unreliable transformers for reducing the hydrophone output-impedance.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Briefly, the present invention is a shock-hardened hydrophone comprising a piezoelectric sensor and a low output-impedance, solid-state preamplifier electrically connected by a circuitboard. The sensor includes two circular piezoceramic disks positioned in metal cups and bolted to both sides of the circuitboard. The force from the bolt shock-hardens the sensor by mechanically preloading the disks. The disks are electrically connected to one end of the circuitboard while the preamplifier is connected to the other end where the input voltage to the preamplifier is the signal generated by the sensor.

Figure 1:
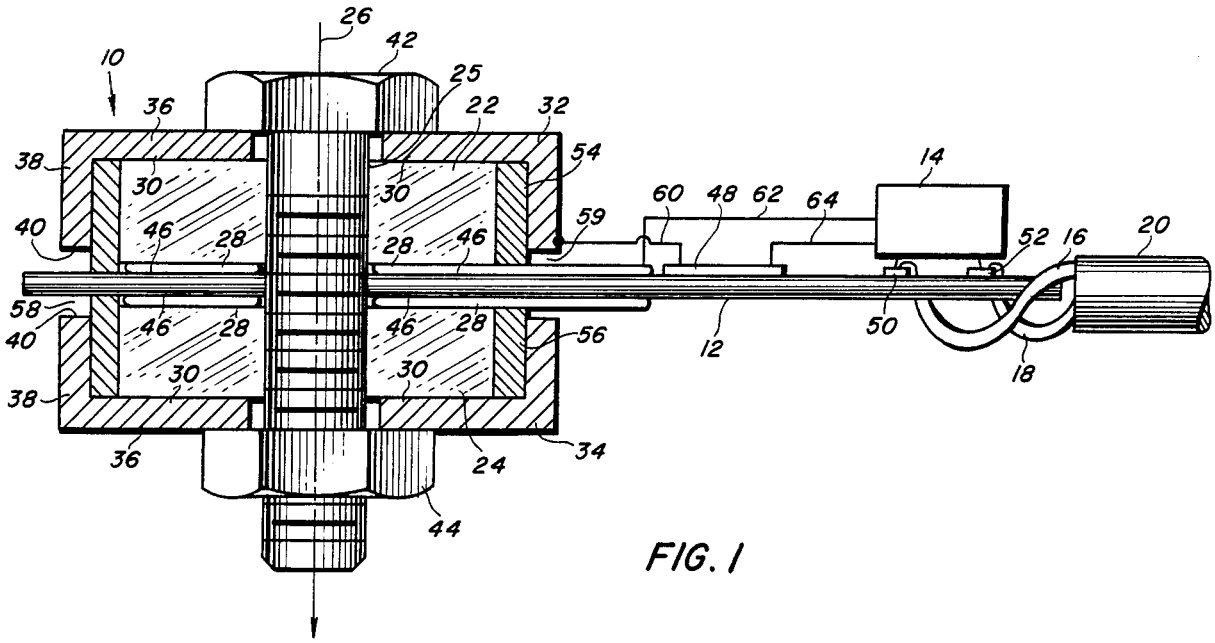
FIG. 1 is a schematic, cross-sectional view of an embodiment of the invention.

Referring now to the drawings, wherein like reference numerals designate identical or corresponding parts throughout the several views, and more particularly to FIG. 1 thereof a cross-sectional view of an embodiment of the present invention including a piezoelectric sensor 10 clamped about the first end of a circuitboard 12 and low output-impedance preamplifier 14 mounted on the second end of the circuitboard. The sensor 10 and preamplifier 14 are electrically connected by a preamplifier circuit pattern disposed on both sides of the circuitboard 12. The conductors 16, 18 from a cable 20 for connecting the hydrophone to the surface are looped through the circuitboard 12 and soldered to the preamplifier circuit pattern. The entire sensor-circuitboard-preamplifier assembly is potted in polyurethane for waterproofing and bonded to the cable 20 which is also polyurethane jacketed.

The sensor depicted in FIG. 1 comprises a pair of piezoelectric disks 22, 24 poled along a longitudinal axis 26 where each disk includes a first surface 28, a second end surface 30 and a hole 25 disposed along the longitudinal axis 26 of the disk. Each disk 22, 24 is enclosed in a metal cup 32, 34 with a base 36, a side 38 and a rim 40. The metal cups 32, 34 are clamped together, with the circuitboard 12 and the disks 22, 24 captured therebetween, by a bolt 42 passing through the metal cups 32, 34, the axial hole 25 of the disks 22, 24, and the circuitboard 12 and by a nut 44 fastened to the end of the bolt 42.

The circuitboard 12 has an upper and a lower surface, a preamplifier pattern with a first electrode 46 disposed on both the upper and lower surfaces, a second electrode 48 disposed on either surface and solder pads 50, 52 for connecting the conductors 16, 18 from the cable 20 to the circuitboard. A layer of pressure release material 54, 56 is positioned between each disk and the sides of the metal cups. Note that a gap 58, 59 is formed between the rim of each metal cup and the first electrode 46 thereby electrically insulating the metal cups from the circuitboard.

The disks 22, 24 are shock-hardened by tightening the nut 44 on the bolt 42. The resulting mechanical strain prevents the disks from shattering in the presence of shocks from nearby explosions.

The clamped together configuration of the sensor about the circuitboard facilitates the electrical connection of the disks to the preamplifier. Each disk is oriented so that its first side 28 is in pressure contact with the first electrode 46 on the circuitboard 12 and its second surface 30 is in pressure contact with the base 36 of a metal cup. The bolt 42 causes the metal cups to be at the same potential while the gap 58, 59 insulates the cups from the first electrode 46. Thus, when the disks are subjected to a mechanical stress caused by an acoustic wave the metal cups will be at the same potential as the second surfaces of the disks while the first electrode will be at the same potential as the first surfaces of the disks. A wire 60 soldered from a metal cup 32 to the second electrode 48 in the circuit pattern completes the electrical connection between the sensor 10 and the circuitboard 12.

The preamplifier 14 input leads 62, 64 are soldered to the first and second electrodes 46, 48 respectively. Thus, the input voltage to the preamplifier is equal to the potential difference between the first and second surfaces of the disks 22, 24.

The manner in which the sensor functions will now be described. An applied mechanical stress along the longitudinal axis 26 of the disks caused by an incident acoustic wave creates a signal voltage between the first and second surface of each disk proportional to the $g_{33}$ constant of the ceramic and the amplitude of the incident wave. Generally, the second surface 30 is at ground and the potential at the first surface 28 is postive relative to the second surface due to the need to shield the positive surface of a piezoelectric transducer. However, a stress perpendicular to the axis 26 of the disk caused by the incident wave creates a voltage signal, proportional to the $g_{31}$ constant, that reduces the signal voltage, thus decreasing the sensitivity of the sensor. The pressure-release layer 54 shields the $g_{31}$ component of the disk from the incident acoustic waves thereby preventing the above-described sensitivity reduction.

In practice, the layer of pressure-release material 54 may be omitted but, a space between disks and the sides 38 of the cups 32, 34 must be included to shield the $g_{31}$ component of the disks. If the pressure release material is omitted, the gap 58 between the rims of the cups and the circuitboard should be sealed with a suitable compliant sealant or gasket.

In the device actually constructed, it was found that the placement of the steel cups over the pressure-release material increased the sensitivity of the sensor because the steel cups acoustically shield the pressure release material to keep it from shunting the sound field. Additionally, the circuitboard was fabricated of fiberglass with an NEMA G-10 rating. However, any low compliance material may be substituted.

Figure 2:
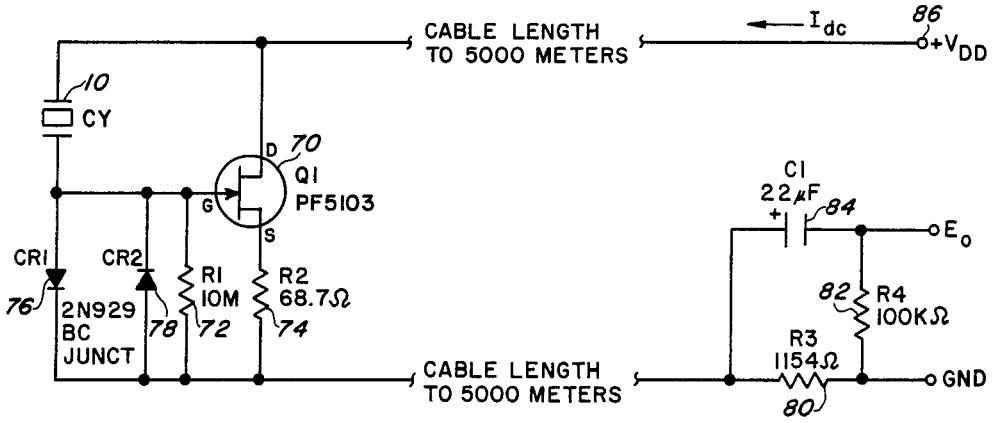
FIG. 2 is a circuit diagram of a preamplifier utilized in the embodiment depicted in FIG. 1.

Referring now to FIG. 2, a circuit diagram for a preamplifier used in a device actually constructed is depicted. FIG. 2 includes exemplary values and model numbers for circuit components, however these values and model numbers do not constitute limitations to the invention claimed and described herein. Those components located within the hydrophone are FET 70, first and second source resistors 72 and 74, first and second diodes 76 and 78, and the pieoelectric ceramic sensor 10. First and second output resistors 80 and 82, and an output capacitor 84 are remotely located at the end of the cable. Cable lengths to 5000 meters cause less than 0.5 dB loss at frequencies up to 1 kHz.

Acoustic pressure causes the ceramic sensor 10 to generate an ac electrical signal which enters the gate of the FET 70 and modulates the dc current $I_{dc}$ which flows from $V_{DD}$ 86 down the cable, through the FET 70 and the second source resistor 74, up the cable, and finally through the first output resistor 80 to ground. The ac output signal, $E_o$, is the voltage drop developed across the second output resistor 82. Note that the output capacitor 84 blocks $I_{dc}$ from flowing through the second output resistor 82 but allows the ac current through. Thus, the capacitor 84 decouples the ac signal from the dc signal.

The amplitude of the electrical signals at the gate of the FET 70 is limited by the diodes 76 and 78. The diodes are essential to protect the preamplifier from the high voltage generated by the ceramic sensor 10 when high pressures are sensed from nearby explosions.

The input resistance of the circuit is not readily obvious even though it appears to be equal to the first source resistor 72. This is a "boot strapped" circuit where positive feedback is applied to the first source resistor 72 which increases its effective value to about 70 MΩ. Bootstrapping causes the hydrophone to have a flat response to lower frequencies without the expense of high megaohm resistors. Since the second source resistor 74 and the first output resistor 80 form a voltage divider, the resistance of the first output resistor should be much greater than the resistance of the second source resistor for optimum performance.

The output resistance is equal to about $1/g_{fs}+R2$ where $g_{fs}$ is the transconductance of the FET and R2 is the magnitude of the resistance of the second source resistor. The typical output resistance is about 125 ohms.

Note that the ceramic sensor 10 is connected between the gate of the FET 70 and $V_{DD}$ 86. If the ceramic sensor 10 were connected between the gate and the junction of the first and second source resistors 72 74, then the circuit would have a gain of about 10 dB but the output resistance would be about 5000 ohms. With the ceramic sensor 10 in the position shown in FIG. 2, the circuit is a source follower configuration with an almost unity gain and a low output resistance. The low output resistance is essential for driving long cables.

Although, the device constructed will function at great depths, the inclusion of 0-ring seals between the rims 40 of the cups and the circuitboard 12 will increase the sensitivity at very great depths (over 5,000 feet).

It will be understood that various changes in the details, materials, steps and arrangements of parts, which have been herein described and illustrated in order to explain the nature of the invention, may be made by those skilled in the art within the principle and scope of the invention as expressed in the appended claims.

What is claimed and desired to be secured by Letters Patent of the United States is:

1. A shock-hardened hydrophone comprising:

a pair of piezoelectric disks, each with a first surface and a second surface, for generating a potential difference between said first and second surfaces in response to an acoustic wave, where the sign of the potential difference between the first and second surface of each disk is the same;

a circuitboard with an upper surface, a lower surface, and a preamplifier circuit pattern disposed thereon, where said circuit pattern includes a first electrode with a section disposed on the upper surface and another section disposed on the lower surface and a second electrode disposed on either surface of the circuitboard;

a pair of metal cups, each metal cup with a base, a side, and a rim, where each disk is positioned within one of said cups with its second surface in pressure contact with the base of said cup so that said metal cup is in electrical contact with said second surface of said disk and at the same electric potential as said second surface;

means for applying a prestressing force to clamp said metal cups together with the disks captured therebetween, said force applying means clamping the disks with a sufficient force to mechanically preload said disks to shock harden the disks due to the mechanical stress caused by the force exerted by said force applying means, wherein the first surface of one of said disks is in pressure contact with the section of the first electrode disposed on the lower surface of said circuitboard and the first surface of the other of said disks in pressure contact with the section of the first electrode disposed on the upper surface of said circuitboard so that said first electrode is electrically connected to the first surfaces of said disks and so that the first electrode is at the same electric potential as said first surface of said disks, wherein each of the rims of said metal cups are insulated from said first electrode and said force applying means for electrically connecting said metal cups so that said metal cups are at the same electric potential;

means for electrically connecting one of said metal cups to the second electrode of the preamplifier circuit pattern so that the second electrode is at the same electric potential as the second surfaces of said disks; and a low output-impedance preamplifier disposed on said circuitboard with its inputs electrically connected to said first and second electrodes of said preamplifier circuit pattern.

2. The hydrophone recited in claim 1 wherein:

said disks are separated from the sides of said metal cups by an air space.

3. The hydrophone recited in claim 1 further comprising:

a layer of pressure release material disposed between said disks and sides of said metal cups.

4. The hydrophone recited in claim 1, 2 or 3 wherein:

the electric potential at said first surface of said disks is positive relative to the electric potential at said second surface of said disks.

5. The hydrophone recited in claim 4 wherein:

said force applying means comprises a bolt passing through said metal cups, said disks and said circuitboard and a nut secured to the end of said bolt.

6. The hydrophone recited in claim 5 wherein:

each of said cups is insulated from said first electrode by a gap between the rim of said cup and said first electrode.

7. The hydrophone recited in claim 6 wherein:

said means for electrically connecting one of said cups to said second electrode is a wire soldered from said cup to said second electrode.

8. A shock hardened hydrophone comprising:

a sensor including two metal cups each with a base, a side and a rim, two piezoelectric disks for generating a potential difference between the first and second surfaces of the disk in response to an acoustic wave where the sign of the potential difference between the first and second surfaces of each disk is the same, and a circuitboard with an upper surface, a lower surface, a first electrode, disposed on both surfaces of said circuitboard, and a second electrode disposed on either surface of said circuitboard, wherein each of said disks are positioned within one of said cups and said cups are clamped together by a bolt and a nut with the cups positioned therebetween, so that the disks are mechanically preloaded by the force exerted by said bolt and nut, wherein the first surfaces of said disks are in pressure contact with said first electrode on said circuitboard so that said first electrode is at the same potential as the first surfaces of said disks, wherein the second surfaces of said disks are in pressure contact with said metal cups, said metal cups being electrically connected by said bolt so that said metal cups are at the same potential as the second surfaces of said disks, and wherein said metal cups are insulated from said first electrode:

means for electrically connecting said metal cups to said second electrode so that said second electrode is at the same potential as the second surfaces of said disks; and a low output-impedance preamplifier mounted on said circuitboard where the input signal to said preamplifier is the potential difference between the first and second electrodes on said circuitboard.

9. The hydrophone recited in claim 8 wherein:

said disks are separated from the sides of said metal cups by an air space.

10. The hydrophone recited in claim 8 further comprising:

a layer of pressure-release material disposed between said disks and sides of said metal cups.

11. The hydrophone recited in claims 8, 9 or 10 wherein:

the electric potential at said first surface of said disks is positive relative to the electric potential at said said second surface of said disks.

12. The hydrophone recited in claim 11 wherein:

each of said cups is insulated from said first electrode by a gap between the rim of said cup and said first electrode.

13. The hydrophone recited in claim 12 wherein:

said means for electrically connecting one of said metal cups to said second electrode is a wire soldered from said cup to said second electrode.

14. A shock-hardened hydrophone comprising:

a circuitboard including an upper side and a lower side and a preamplifier pattern with a first electrode disposed on both sides of said circuitboard and a second electrode disposed on either surface of said circuitboard;

a pair of circular piezoelectric ceramic disks for generating a potential difference between the first surface and the second surfaces of each disk where the sign of the potential difference between the first and second surfaces is positive;

a pair of cylindrical steel cups. each with a base, a side, and a rim, bolted together with one of said disks positioned in each cup, wherein said circuitboard is positioned between said disks with the first surface of each disk being in pressure contact with said first electrode so that said first electrode is at the same potential as the first surfaces of said disks and the second surface of each disk in pressure contact with the base of one of said cups so that said cups are at the same potential as the second surfaces of said disks and wherein the height of each cup is less than the thickness of each disk so that the rims of said cup are not in contact with said first electrode;

a wire soldered from one of said metal cups to said second electrode so that said second electrode is at the same electric potential as the second surfaces of said disks;

a layer of pressure release material positioned between the side of each cup and the disk positioned therein;

a preamplifier, connected to said circuitboard, with a first input wire soldered to said first electrode and a second input wire soldered to said second electrode.

* * * * *